US010994285B2

(12) United States Patent
Stout et al.

(10) Patent No.: US 10,994,285 B2
(45) Date of Patent: May 4, 2021

(54) SYSTEMS AND METHODS OF COMMUNICATING CENTRIFUGE STATUS BY LED ILLUMINATOR OF CENTRIFUGE HOUSING

(71) Applicant: THE DRUCKER COMPANY, LLC, Port Matilda, PA (US)

(72) Inventors: Craig Stout, Port Matilda, PA (US); Christoper L. Ivory, State College, PA (US)

(73) Assignee: THE DRUCKER COMPANY, LLC, Port Matilda, PA (US)

( * ) Notice: Subject to any disclaimer, the term of this patent is extended or adjusted under 35 U.S.C. 154(b) by 1001 days.

(21) Appl. No.: 15/471,263

(22) Filed: Mar. 28, 2017

(65) Prior Publication Data

US 2017/0274393 A1 Sep. 28, 2017

Related U.S. Application Data

(60) Provisional application No. 62/314,112, filed on Mar. 28, 2016.

(51) Int. Cl.

| | |
|---|---|
| ***B04B 7/02*** | (2006.01) |
| ***B04B 13/00*** | (2006.01) |
| ***B04B 7/06*** | (2006.01) |

(52) U.S. Cl.

CPC ..... *B04B 7/02* (2013.01); *B04B 7/06* (2013.01); *B04B 13/00* (2013.01)

(58) Field of Classification Search

CPC ..... B04B 7/02; B04B 7/06; B04B 13/00

USPC ..... 494/10

See application file for complete search history.

(56) References Cited

U.S. PATENT DOCUMENTS 3,174,341 A * 3/1965 Sudo ..... G01K 13/08 374/154
4,961,724 A * 10/1990 Pace ..... B04B 1/08 494/44
5,855,773 A * 1/1999 Lasota ..... B04B 7/02 210/146

(Continued)

FOREIGN PATENT DOCUMENTS

KR 2002076668 * 10/2002 ..... B04B 7/02

*Primary Examiner* — Walter D. Griffin
*Assistant Examiner* — Shuyi S. Liu
(74) *Attorney, Agent, or Firm* — McNees Wallace & Nurick LLC

(57) ABSTRACT

A centrifuge includes light sources to provide different illumination states depending on the status of the centrifuge to communicate the status of the centrifuge. The light sources, when activated, project light in the centrifuge chamber and through the centrifuge lid. The light sources are preferably light-emitting diodes. The illumination state is visible up to at least a distance from the centrifuge at which no other visual information on the centrifuge is available. The illumination states allow staff to visually identify the status of a centrifuge from a distance and may reduce turnaround times by enabling staff to identify a completed centrifuge cycle more quickly, reduce staff time wasted checking on the status of a centrifuge, and reduce turnaround time wasted as a result of specimens sitting in a centrifuge after the centrifuge cycle has completed. Methods of communicating the status of a centrifuge are also disclosed.

13 Claims, 3 Drawing Sheets

(56) References Cited

U.S. PATENT DOCUMENTS

| | | | | |
|---|---|---|---|---|
| 5,935,051 | A * | 8/1999 | Bell | A61M 1/3693 210/85 |
| 2013/0164789 | A1* | 6/2013 | Schultz | C12P 19/34 435/91.2 |
| 2014/0235421 | A1* | 8/2014 | Rogers | B04B 5/0442 494/10 |
| 2015/0174592 | A1* | 6/2015 | Ooyama | B04B 11/00 494/10 |

* cited by examiner

SYSTEMS AND METHODS OF COMMUNICATING CENTRIFUGE STATUS BY LED ILLUMINATOR OF CENTRIFUGE HOUSING

FIELD OF THE INVENTION

The present invention is directed to systems and methods of communicating the status of a centrifuge. More specifically, the invention is directed to systems and methods of illuminating the housing or chamber of a centrifuge to indicate the status of the centrifuge.

BACKGROUND OF THE INVENTION

Clinical laboratories are seemingly chaotic with lots of activity resulting from processing high volumes of samples using various systems and methods. Many analyzers and instruments are used in a clinical laboratory, each instrument producing pumping, conveying, pneumatic, mechanical, and electronic noises. Audible indicators and alarms are used for most laboratory equipment, but due to the sheer volume of analyzers in a clinical laboratory and the fast-paced activities, the audible alarms are barely perceivable as they all blur into a continuous environment of white noise.

Visual indicators are also used in the form of digital displays to indicate the status of a device. However, the operator must be nearby and in front of the analyzer or instrument to be able to see the visual indicator and interpret its meaning. The status indicator used in a display is not perceivable from a distance.

Clinical laboratories are under significant pressure to reduce their turnaround time (TAT). TAT is the amount of time from the point at which the physician has ordered a diagnostic test on a patient to the point at which the clinical laboratory releases and delivers the clinical results of the diagnostic test. Although the analysis portion of the TAT is usually only 15 minutes or less, the total TAT is often 40 minutes or more. In many cases, pre-analytic processes lead to the majority of the TAT being consumed by handling and specimen centrifugation processes. Centrifuges are used to separate blood specimens into the necessary components for analysis.

Due to the size and required quantity of centrifuges in a clinical laboratory, the centrifuges are often located in one or more areas separate from the location of the analyzers. In such laboratories, operators must walk back and forth between the centrifuge area and the areas where they perform their other duties, including operating the analyzers and preparing other specimen. Often the status of a centrifuge is not readily apparent—whether the centrifuge is available for use, whether centrifugation is in process, or whether one or more specimens are still waiting in a centrifuge after completion of the centrifuge cycle, leading to a longer turnaround time. This condition leads to longer diagnostic turnaround times or lost time for laboratory staff as one of two events occur. Either the staff stand in front of the centrifuge, waiting for the centrifuge cycle to complete, thereby wasting time that could be otherwise spent performing other duties, or the staff work on other items in the laboratory while the centrifuge operates, often resulting in the centrifuge cycle finishing long before the operator returns, thereby losing costly processing time and extending the TAT for the clinical laboratory.

Although conventional centrifuges may provide an indication of the status of the centrifuge, these indications require the technician to be close to the centrifuge to receive the indication. Auditory indications may be missed in the bustle of activity in the laboratory, and even when an auditory indication is heard, it may not be possible to identify which one of the group of centrifuges provided the indication. Visual indications may be provided on a display panel or control panel, but these visual indications require the technician to be close to the centrifuge to see.

BRIEF DESCRIPTION OF THE INVENTION

A centrifuge includes light sources to provide different illumination states depending on the status of the centrifuge to communicate the status of the centrifuge. The light sources, when activated, project light in the centrifuge chamber and through the centrifuge lid. The light sources are preferably light-emitting diodes (LEDs). The illumination state is visible up to at least a distance from the centrifuge at which no other visual information on the centrifuge is available. The illumination states allow staff to visually identify the status of a centrifuge from a distance and may reduce turnaround times by enabling staff to identify a completed centrifuge cycle more quickly, reduce staff time wasted checking on the status of a centrifuge, and reduce turnaround time wasted as a result of specimens sitting in a centrifuge after the centrifuge cycle has completed. Methods of communicating the status of a centrifuge are also disclosed.

In an embodiment, a method of communicating a status of a centrifuge includes providing a first illumination state, a second illumination state, and a third illumination state. The first illumination state, the second illumination state, and the third illumination state are different and selected from the group consisting of no illumination of a housing or chamber of the centrifuge, steady illumination of the housing or chamber in a first color of the centrifuge, intermittent illumination of the housing or chamber in the first color of the centrifuge, steady illumination of the housing or chamber in a second color of the centrifuge, intermittent illumination of the housing or chamber in the second color of the centrifuge, and steady illumination of the housing or chamber in a third color of the centrifuge.

In another embodiment, a method of communicating a status of a centrifuge includes providing a first illumination state corresponding to a first status of the centrifuge, and a second illumination state corresponding to a second status of the centrifuge.

In another embodiment, a centrifuge includes a housing defining a chamber, a lid movable between an open state and a closed state over the chamber, a sample holder in the chamber capable of holding at least one specimen, a motor in the housing operatively connected to spin the sample holder, light sources, and a control system coupled to the motor and the plurality of light sources, wherein the control system directs the plurality of light sources to provide a first illumination state, a second illumination state, and a third illumination state. The first illumination state, the second illumination state, and the third illumination state provide different visual indications of the status of the centrifuge.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are systems and methods of communicating the status of a centrifuge by illuminating the centrifuge chamber using one or more light sources, which in a currently preferred embodiment includes light-emitting diodes (LEDs).

Embodiments of the present disclosure, for example, in comparison to concepts failing to include one or more of the features disclosed herein, allow staff to visually identify the status of a centrifuge from a distance, reduce turnaround times by enabling staff to identify a completed centrifuge cycle more quickly, reduce staff time wasted checking on the status of a centrifuge, reduce turnaround time wasted as a result of specimens sitting in a centrifuge after the centrifuge cycle has completed, or combinations thereof.

Figure 1:
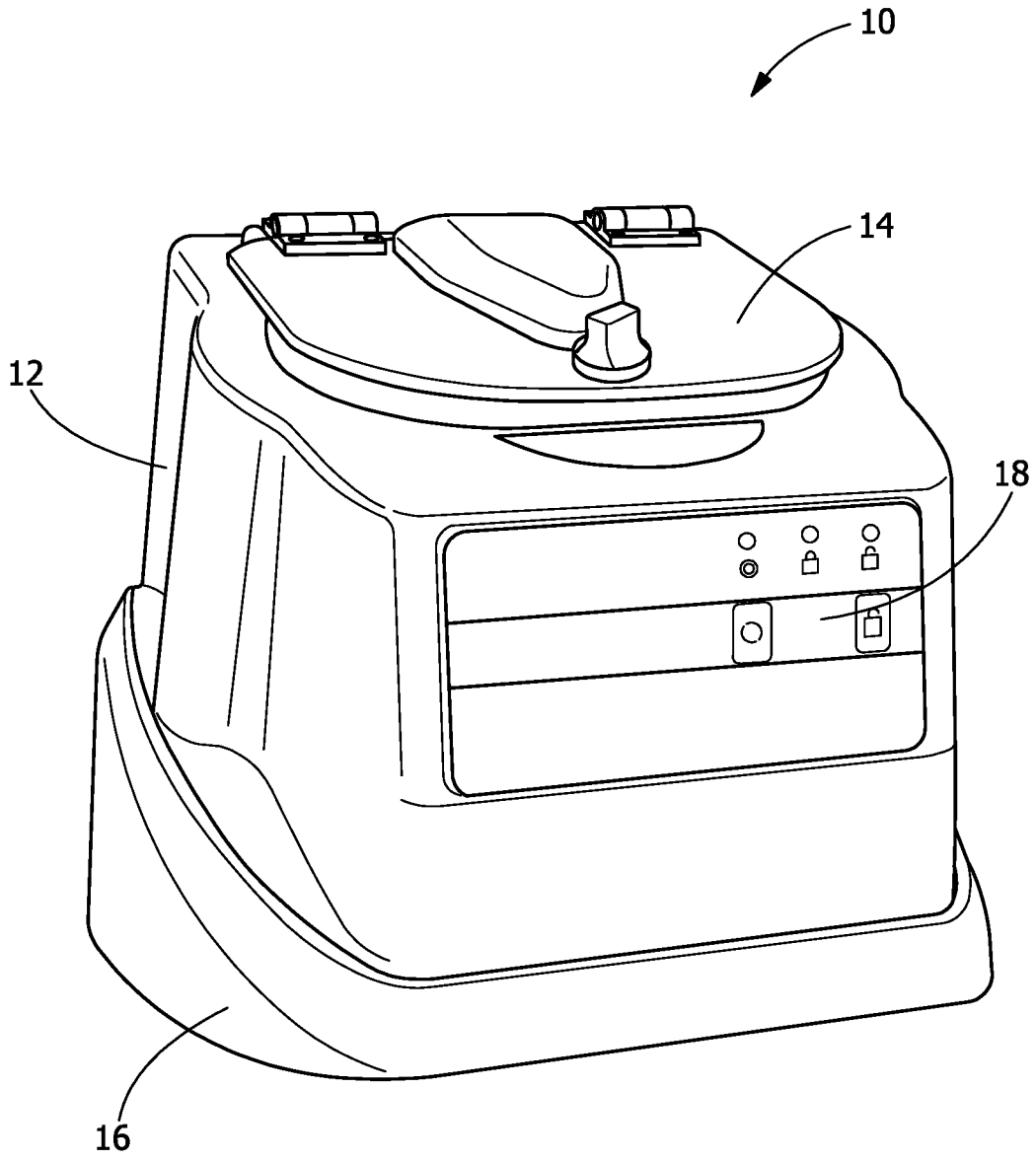
FIG. 1 is a front perspective view of a centrifuge in an embodiment of the present disclosure.

FIG. 1 shows a centrifuge 10 with a centrifuge housing 12, a lid 14, and an optional stand 16. The housing includes an operator interface 18. The lid 14 is made of a translucent or transparent material, such as polycarbonate, other polymeric material, glass, or other non-polymeric translucent material, for example. The centrifuge housing 12 may also be made of a translucent or transparent material. The centrifuge 10 includes at least one light source 52 (see FIG. 3) embedded in the lid 14 or located in the centrifuge housing 12.

Figure 2:
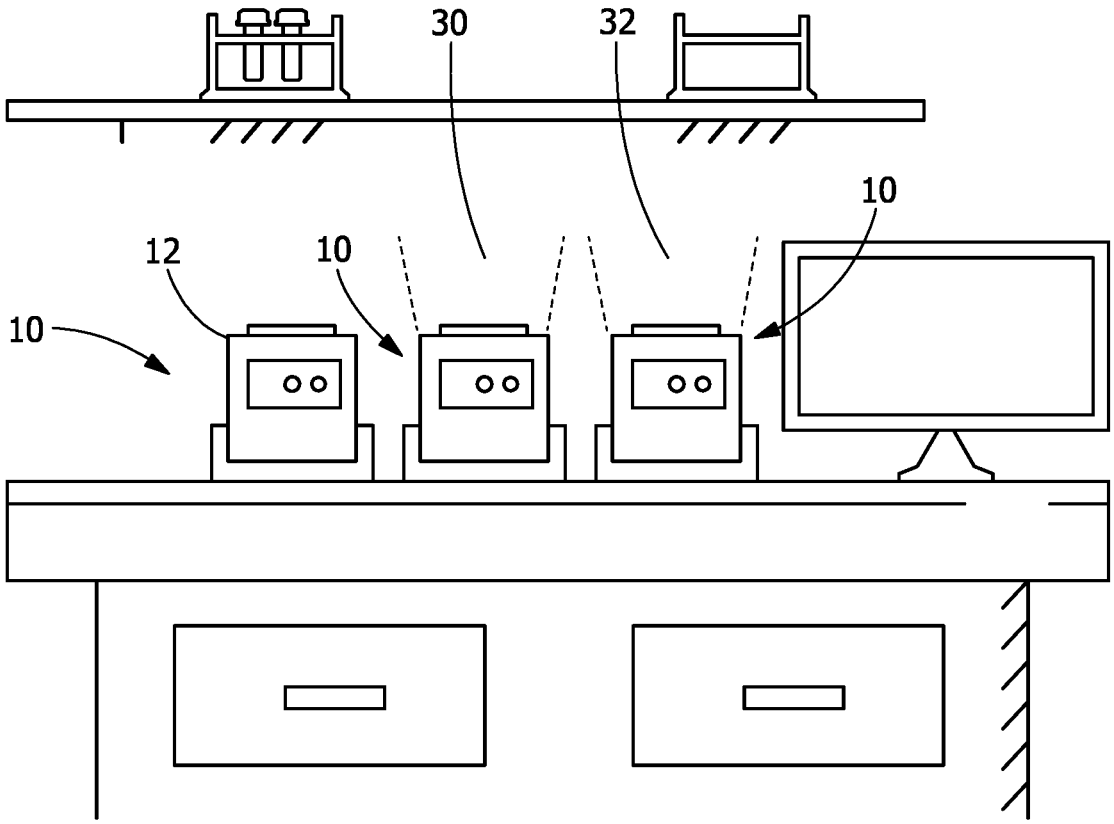
FIG. 2 is a schematic front view of a set of the centrifuges of FIG. 1.

FIG. 2 shows three centrifuges 10 on a workbench 20 of a clinical laboratory. The left centrifuge 10 is empty and available, as indicated by no illumination in the centrifuge housing 12 by the centrifuge 10. The center centrifuge 10 is in the middle of a cycle with one or more specimens being centrifuged, as indicated by the steady illumination 30 in the centrifuge housing 12 by the centrifuge 10. The right centrifuge 10 has completed a cycle with one or more centrifuged specimens ready to be removed, as indicated by the intermittent illumination 32 in the centrifuge housing 12 by the centrifuge 10.

Figure 3:
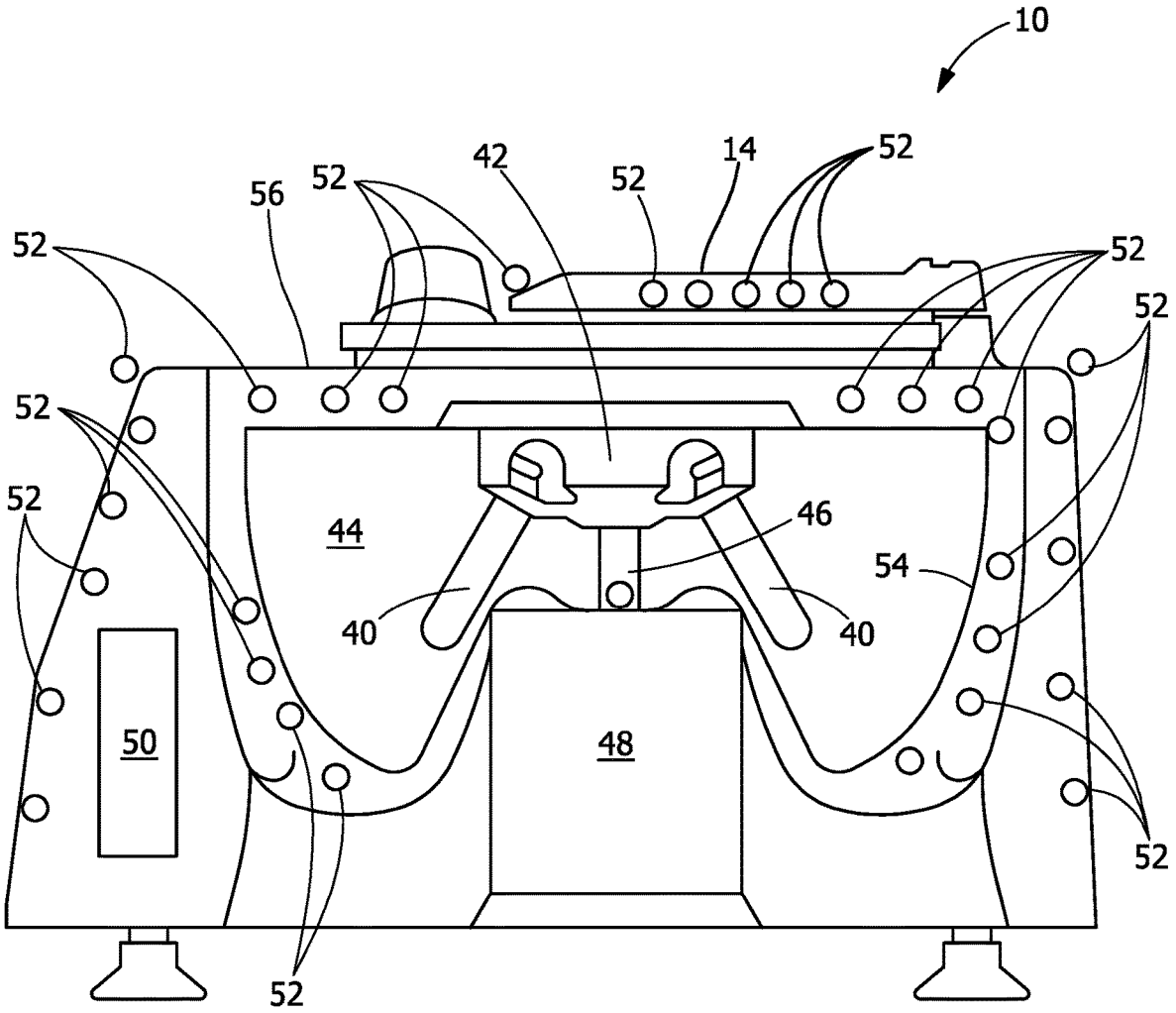
FIG. 3 is a schematic partial cross sectional view of the centrifuge of FIG. 1.

FIG. 3 shows two specimens 40 held in a sample holder 42 in the chamber 44 of the centrifuge 10. The sample holder 42 sits on the drive shaft 46 of the motor 48 of the centrifuge 10. The motor 48 drives the drive shaft 46 to rotate the sample holder 42 at a high rate of speed to centrifuge the specimens 40. A control system 50 including electronics within the centrifuge housing 12 is operatively connected to control the motor 48 as well as the light sources 52 that illuminate the centrifuge housing 12 or the centrifuge chamber 44 and above the centrifuge 10 through the lid 14. The light sources 52 may be imbedded in or adjacent any part of the structure defining the housing 12 or the chamber 44, including, but not limited to, the outer portions of the housing 12, the chamber walls 54, the chamber lip 56, and the lid 14 itself. In some embodiments, a light source 52 is located in the center of the rotor, with a slip ring or a hollow drive shaft 46 facilitating upward illumination by the light source 52. In some embodiments, the light sources 52 are mounted on the edge of the lid 14 or an edge of the centrifuge housing 12, with the lid 14 or the centrifuge housing 12 serving as a light pipe to illuminate its edges.

In some embodiments, at least a significant portion (an area greater than 20%) of one side of the centrifuge housing 12 is illuminated, while in others at least 50% of the area of the side is illuminated. In other embodiments, a portion of multiple sides of the centrifuge housing 12 is illuminated. In still other embodiments, a portion of all sides of the centrifuge housing 12 are illuminated. In other embodiments, a majority of each of the four sides of the centrifuge housing 12 is illuminated. Additionally or alternatively, the lid 14 and/or bottom of the centrifuge 10 may be illuminated in combination with one or more lighted sides of the centrifuge housing 12 and/or in combination with light shining through a transparent or translucent lid 14, sides 12 or bottom of the centrifuge 10 via illumination of the centrifuge chamber 44.

The status of the centrifuge 10 is communicated based on an illumination of the centrifuge housing 12 and/or the centrifuge chamber 44 and above the centrifuge 10 by the centrifuge 10. In some embodiments, the centrifuge 10 includes multiple illumination states representing multiple centrifuge 10 statuses. In an embodiment, a first illumination state indicates a first status, (e.g., the centrifuge 10 is available), a second illumination state indicates a second status, (e.g., the centrifuge 10 is actively in operation processing one or more specimens 40), and a third illumination state indicates a third status, (e.g., the centrifuge 10 has finished a cycle and the specimens 40 are ready to be removed).

Other information may be communicated with other illumination states. For example, an additional illumination state may indicate a malfunction in the operation of the centrifuge 10 requiring operator intervention. Another additional illumination state may indicate less than a predetermined amount of time remaining until the completion of a centrifuge cycle. In some embodiments, the predetermined amount of time is one minute, alternatively less than one minute, alternatively thirty seconds, alternatively less than thirty seconds, alternatively twenty seconds, alternatively fifteen seconds, alternatively less than fifteen seconds, alternatively ten second, alternatively five seconds, or an amount, range, or sub-range therebetween. In some embodiments, the predetermined amount of time may be selected by the operator.

One illumination state may be the lack of illumination of the centrifuge housing 12 or centrifuge chamber 44 by the centrifuge 10. Another illumination state may be the steady illumination of the centrifuge housing 12 or centrifuge chamber 44 in a first color by the centrifuge 10. Another illumination state may be the intermittent illumination of the centrifuge housing 12 or centrifuge chamber 44 in the first color by the centrifuge 10. Yet another illumination state may be the steady illumination of the centrifuge housing 12 or centrifuge chamber 44 in a second color by the centrifuge 10. Another illumination state may be the intermittent illumination of the centrifuge housing 12 or centrifuge chamber 44 in the second color by the centrifuge 10. Yet another illumination state may be the steady illumination of the centrifuge housing 12 or centrifuge chamber 44 in a third color by the centrifuge 10. Yet another illumination state may be the steady illumination of the centrifuge housing 12 or centrifuge chamber 44 in a fourth color by the centrifuge 10. Any color light source may be used to convey a centrifuge status within the spirit of the present invention.

Additional illumination states may include the intermittent illumination of the centrifuge housing 12 or centrifuge chamber 44 in multiple colors (e.g., first color, second color, third color, fourth color, and combinations thereof). One illumination state may include the centrifuge housing 12 or centrifuge chamber 44 simultaneously illuminated by multiple colors. Another illumination state may include the centrifuge housing 12 or centrifuge chamber 44 intermittently simultaneously illuminated by multiple colors. Another illumination state may include the centrifuge housing 12 or centrifuge chamber 44 sequentially illuminated in multiple colors (e.g., alternating red/green, sequential red/green/blue). Another illumination state may include the centrifuge housing 12 or centrifuge chamber 44 intermittently illuminated by a pattern of light sources 52. The pattern of illuminating light sources may include one or more colors. The pattern of illuminating light sources 52 may include a rhythmic code, such as, a predetermined number of blinks and a pause. The pattern of illuminating light sources 52 may sequentially illuminate differing portions of the centrifuge housing 12 or centrifuge chamber 44.

In some embodiments one or more LEDs serve as the light sources 52 to illuminate the centrifuge housing 12 or centrifuge chamber 44. In some embodiments, a series of LED devices are imbedded in or mounted onto one or more translucent or transparent components that make up part or all of the housing 12 or lid 14 of the centrifuge 10.

In some embodiments, the centrifuge housing 12 or centrifuge chamber 44 is illuminated a first predetermined color by the LEDs while the centrifuge 10 is operating. After the operation is complete and the specimens 40 are ready to be removed, the centrifuge housing 12 or centrifuge chamber 44 is illuminated in a second predetermined color different from the first predetermined color. When the centrifuge 10 is idle and available for use, the centrifuge housing 12 or centrifuge chamber 44 is not illuminated.

In some embodiments, the centrifuge housing 12 or centrifuge chamber 44 is illuminated a first predetermined color by the LEDs while the centrifuge 10 is operating. After the operation is complete and the specimens 40 are ready to be removed, the centrifuge housing 12 or centrifuge chamber 44 is illuminated in an intermittent flashing of the first predetermined color. When the centrifuge 10 is idle and available for use, the centrifuge housing 12 or centrifuge chamber 44 is not illuminated.

The multiple illumination states have been shown to improve laboratory efficiency and reduce turnaround time for laboratory samples. In some embodiments, for example, the centrifuge 10 is lighted in green when operating and begins flashing green when complete.

Although certain illumination states have been described as corresponding to certain centrifuge states, any illumination state may be used to represent any status of the centrifuge 10 to form a system of uniquely communicating the status of the centrifuge 10 by the illumination states.

In some embodiments, the centrifuge 10 runs on a 0.5 horsepower, alternatively in the range of 0.25 to 0.75 horsepower, brushless direct current centrifuge motor and operates at 5300 RPM (about 4000 g), alternatively in the range of 5000 to 5500 RPM, to centrifuge one or more specimens 40 in a process time of about three minutes or less, alternatively about five minutes or less.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A centrifuge comprising:

a housing defining a chamber;

a lid movable between an open state and a closed state over the chamber, wherein the lid is transparent or translucent;

a sample holder in the chamber capable of holding at least one specimen;

a motor in the housing operatively connected to spin the sample holder;

a first plurality of light sources, each light source being located to project light of a predetermined color through and above the lid, each light source being controllable between an on state producing the light of the predetermined color and an off state producing no light; and a control system coupled to the motor and the first plurality of light sources, wherein the control system is configured to direct the first plurality of light sources to provide a visual indication as a first illumination state corresponding to a first status of the centrifuge, a second illumination state corresponding to a second status of the centrifuge, and a third illumination state corresponding to a third status of the centrifuge;

wherein at least one of the first plurality of light sources is located in the motor.

2. The centrifuge of claim 1, wherein the light sources are light-emitting diodes.

3. The centrifuge of claim 1, further comprising a drive shaft, wherein the motor drives the drive shaft to rotate the sample holder, the drive shaft is hollow to allow upward illumination through the lid by the at least one of the first plurality of light sources.

4. The centrifuge of claim 1, wherein at least one of the first plurality of light sources is embedded in the lid.

5. The centrifuge of claim 1, wherein the lid includes a polycarbonate or a glass.

6. The centrifuge of claim 1, wherein at least one of the first illumination state, the second illumination state, or the third illumination state intermittently illuminates at least a portion of the chamber.

7. The centrifuge of claim 1, wherein the housing includes at least one translucent or transparent component.

8. The centrifuge of claim 7, wherein the housing includes a material comprising a polycarbonate or a glass.

9. The centrifuge of claim 7 further comprising a second plurality of light sources located in the housing, the second plurality of light sources also providing the visual indication as the first illumination state, the second illumination state, and the third illumination state.

10. The centrifuge of claim 9, wherein at least one of the first illumination state, the second illumination state, or the third illumination state from one or both of the first plurality of light sources and the second plurality of light sources illuminates at least 20 percent of at least one side of the centrifuge housing.

11. The centrifuge of claim 10, wherein at least one of the first illumination state, the second illumination state, or the third illumination state illuminates at least 50 percent of at least one side of the centrifuge housing.

12. The centrifuge of claim 1, wherein the housing comprises a chamber wall defining the chamber and wherein at least one of the first plurality of light sources is located in the chamber wall.

13. The centrifuge of claim 1, wherein the first status of the centrifuge is available, the second status of the centrifuge is actively processing the at least one specimen; and the third status of the centrifuge is finished with the at least one specimen ready for removal.

* * * * *